US005265779A

United States Patent [19]

Jiang

[11] Patent Number: 5,265,779

[45] Date of Patent: Nov. 30, 1993

[54] MANNEQUIN WITH ADJUSTABLE PARTS

[76] Inventor: Jong-Ming Jiang, No.7, Hang-Chou I St., Chiayi City, Taiwan

[21] Appl. No.: 991,209

[22] Filed: Dec. 15, 1992

[51] Int. Cl.[5] ..... D06C 15/00

[52] U.S. Cl. ..... 223/68; 223/66

[58] Field of Search ..... 223/68, 71, 66, 84; 206/292, 293, 28, 27

[56] References Cited

U.S. PATENT DOCUMENTS

| | | | |
|---|---|---|---|
| 2,059,338 | 11/1936 | Goodsill | 223/68 |
| 2,909,370 | 10/1959 | Fortney | 223/66 |
| 4,493,445 | 1/1985 | Arthur | 223/68 |
| 4,793,530 | 12/1988 | Krotseng | 223/68 |

FOREIGN PATENT DOCUMENTS

| | | | |
|---|---|---|---|
| 1024888 | 9/1950 | France | 223/66 |
| 2064195 | 6/1981 | United Kingdom | 223/68 |

*Primary Examiner*—Clifford D. Crowder
*Assistant Examiner*—Bibhu Mohanty
*Attorney, Agent, or Firm*—Nixon & Vanderhye

[57] ABSTRACT

A mannequin includes a support frame and a horizontal support assembly which includes an upper horizontal support unit, a middle horizontal support unit and a lower horizontal support unit. Each of the horizontal support units includes a generally horizontal middle tube mounted movably on the support frame, two generally horizontal side tubes mounted respectively and movably within two end portions of the horizontal middle tube, and an adjustment unit installed on the horizontal middle tube and actuatable so as to move the horizontal side tubes on the horizontal middle tube. Each of the horizontal side tubes includes a rack secured to an inner end portion thereof. The adjustment unit is provided with a fixed pinion that engages the racks of the horizontal side tubes so that rotation of the adjustment unit moves the horizontal side tubes relative to the horizontal middle tube. A chest-outline simulating plate is supported on the top end portion of the support frame. Shoulder-outline, waist-outline and hip-outline simulating plates are respectively supported on the outer end portions of the horizontal side tubes of the upper, middle and lower horizontal support units. Two upper limb units are respectively coupled with the shoulder-outline simulating plates.

3 Claims, 7 Drawing Sheets

MANNEQUIN WITH ADJUSTABLE PARTS

BACKGROUND OF THE INVENTION

1. Field of the Invention

This invention relates to a mannequin, more particularly to a mannequin in which the height and width of the shoulder, waist and hip parts can be adjusted.

2. Description of the Related Art

Normally, the height and width of the shoulder, waist or hip part of a conventional mannequin are fixed. As a result, the size of the clothing which can be fitted on the mannequin is limited.

SUMMARY OF THE INVENTION

Therefore, the main object of this invention is to provide a mannequin which can be adjusted so as to be fitted with different sizes of clothing thereon.

According to this invention, a mannequin includes a support frame and a horizontal support assembly which includes an upper horizontal support unit, a middle horizontal support unit and a lower horizontal support unit. The horizontal support units are spaced apart from each other and are mounted movably on the support frame. Each of the horizontal support units includes a generally horizontal middle tube that is mounted movably on the support portion of the support frame, means for locking the horizontal middle tube releasably on the support frame, two generally horizontal side tubes mounted respectively and movably within two end portions of the horizontal middle tube, and an adjustment unit installed on the horizontal middle tube and actuatable so as to move the horizontal side tubes on the horizontal middle tube. Each of the horizontal side tubes includes a rack secured to an inner end portion thereof. The adjustment unit is provided with a fixed pinion that engages the racks of the horizontal side tubes so that rotation of the adjustment unit moves the horizontal side tubes relative to the horizontal middle tube. A chest-outline simulating plate is supported on the top end portion of the support frame. Two shoulder-outline simulating plates are respectively supported on the outer end portions of the horizontal side tubes of the upper horizontal support unit. Two upper limb units are respectively coupled with the shoulder-outline simulating plates. Two waist-outline simulating plates are respectively supported on the horizontal side tubes of the middle horizontal support unit. Two hip-outline simulating plates are respectively supported on the horizontal side tubes of the lower horizontal support unit. Accordingly, the height and width of each of the horizontal support units can be adjusted.

BRIEF DESCRIPTION OF THE DRAWING

Other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
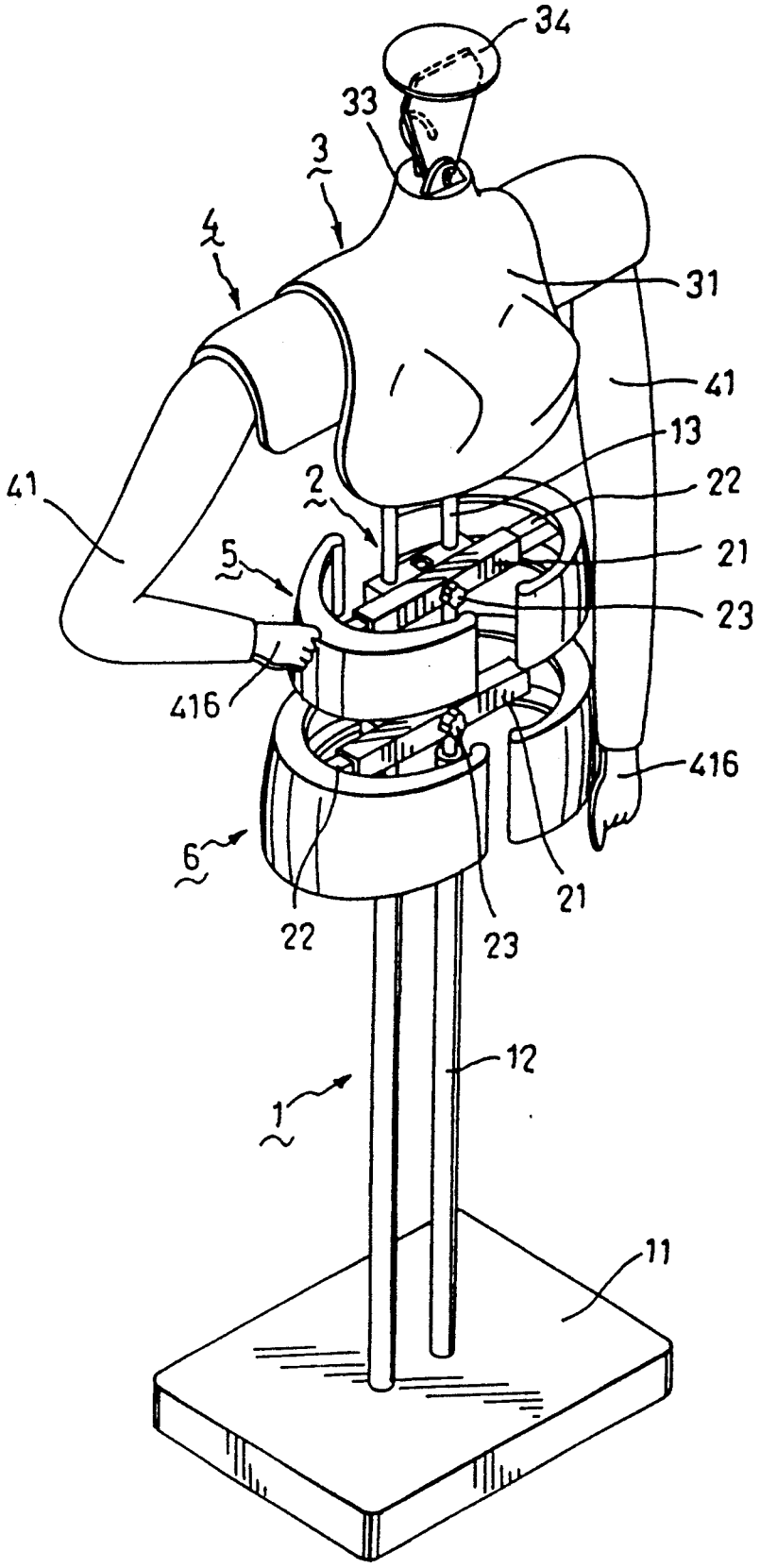
FIG. 1 is a perspective view of a mannequin according to this invention.
Figure 2:
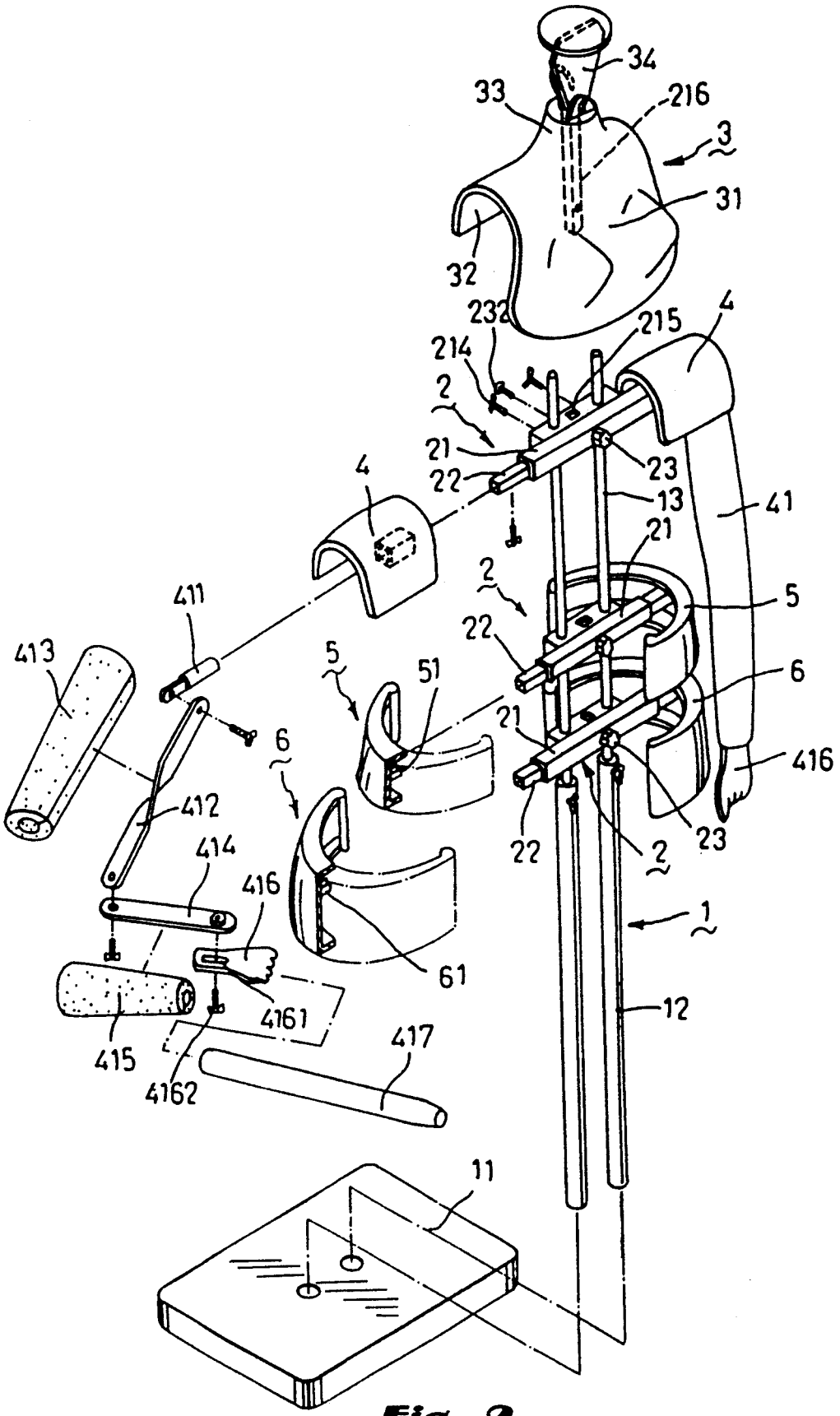
FIG. 2 is a partially exploded view showing the mannequin of this invention.

Referring to FIGS. 1 and 2, a mannequin of this invention includes a support frame (1), three similar horizontal support units (2), a chest-outline simulating plate (3), two shoulder-outline simulating plates (4), two waist-outline simulating plates (5) and two hip-outline simulating plates (6).

The support frame (1) includes a base plate (11), two vertical large lower tubes (12) fixed on the base plate (11), and two vertical small upper tubes (13) mounted respectively and movably on the large lower tubes (12) so that the height of the support frame (1) can be adjusted.

Figure 3:
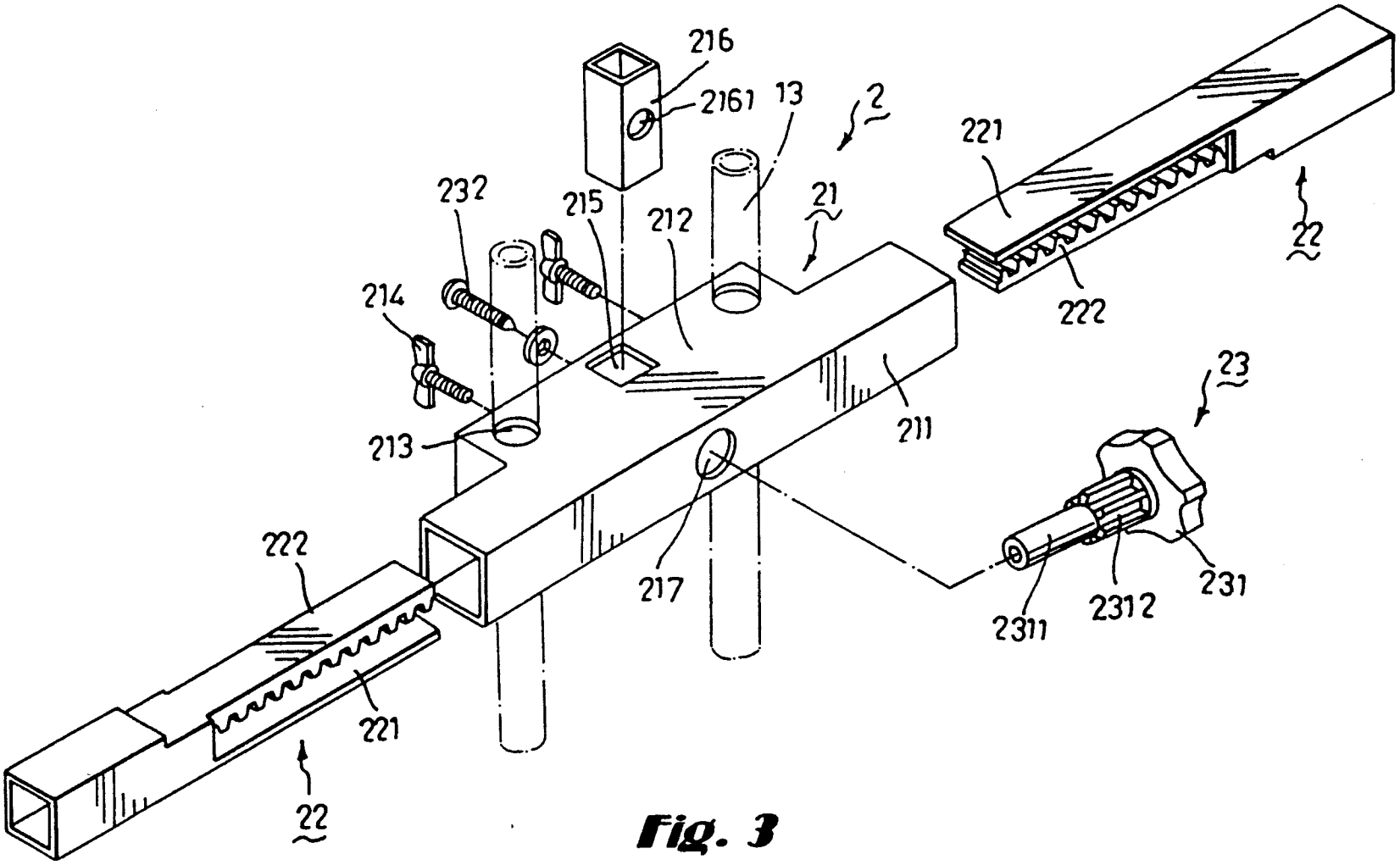
FIG. 3 is an exploded view showing the horizontal middle tube of the mannequin according to this invention.
Figure 4:
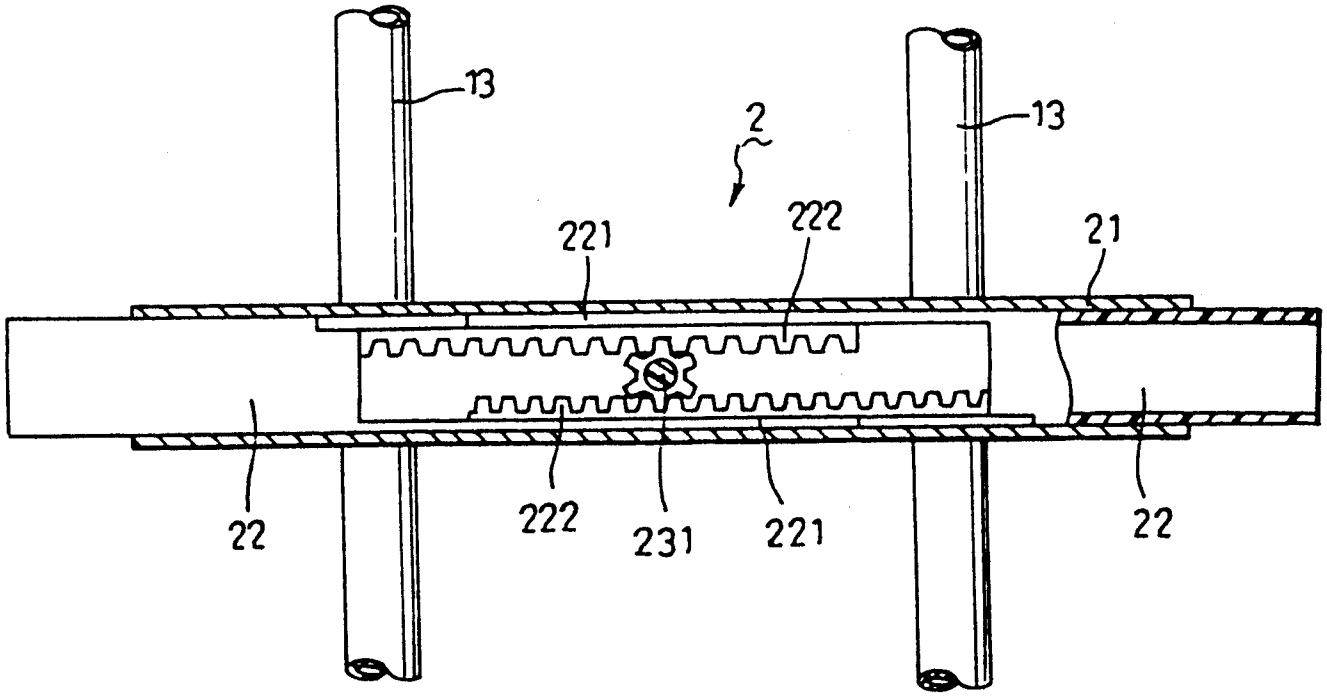
FIG. 4 is a schematic view illustrating the connection between the horizontal middle tube and the horizontal side tubes of the mannequin according to this invention.

The horizontal support units (2) are spaced apart from each other. Referring to FIGS. 3 and 4, each of the horizontal support units (2) includes a generally horizontal middle tube (21), two generally horizontal side tubes (22) and an adjustment unit (23). The horizontal middle tube (21) is integrally formed with a sliding body (212) which has two circular holes (213). The small upper tubes (13) extend through the circular holes (213) of the sliding body (212). Two lock bolts (214) are mounted on the sliding body (212) so as to lock the sliding body (212) releasably on the small upper tubes (13), thereby mounting the horizontal middle tube (21) movably on the support frame (1). The sliding body (212) further has a square hole (215) formed through the middle portion thereof, through which a rectangular tube (216) passes. The inner end portion of each of the horizontal side tubes (22) includes a planar guide plate (221) and a rack (222). The adjustment unit (23) consists of a rotary knob (231) with an internally threaded stem (2311), and a lock bolt (232) extending through the fastener hole (2161) of the rectangular tube (216) to engage the internally threaded stem (2311) of the rotary knob (231). A pinion (2312) is provided on the stem (2311) of the rotary knob (231) and engages the racks (222) of the horizontal side tubes (22) at two opposite sides thereof. The rotation of the rotary knob (23) can adjust the distance between the horizontal side tubes (22). Accordingly, the height and width of the horizontal support units (2) are adjustable.

The chest-outline simulating plate (3) is supported on the rectangular tube (216) of the upper horizontal support unit (2) and has a chest portion (31), a back portion (32), a neck portion (33) and a head support portion (34).

The shoulder-outline simulating plates (4) are respectively supported on the horizontal side tubes (22) of the upper horizontal support unit (2). As described hereinbefore, the distance between the shoulder-outline simulating plates (4) can be adjusted. As best shown in FIG. 2, two upper limb units (41) are attached to the outer ends of the horizontal side tubes (22) of the upper horizontal support units (2). Each of the upper limb units (41) includes a pivot joint (411) secured to the horizontal side tube (22), an elongated metal upper arm frame (412) connected pivotally and removably to the pivot joint (411), an upper sponge tube (413) sleeved on the upper arm frame (412), an elongated metal forearm frame (414) connected pivotally and removably to the upper arm frame (412), and a lower sponge tube (415) sleeved on the forearm frame (414). A hand-outline simulating plat (416) has a slot (4161) formed therethrough. A pivot pin (4162) extends through the slot (4161) of the hand-outline simulating plate (416) to couple with the forearm frame (414). As a result, the hand-outline simulating plate (416) is mounted removably on the forearm frame (414) and is movable and rotatable relative to the forearm frame (414). An elastic tube (417) is sleeved closely on the upper and lower sponge tubes (413, 415) for aesthetic purposes.

Figure 5:
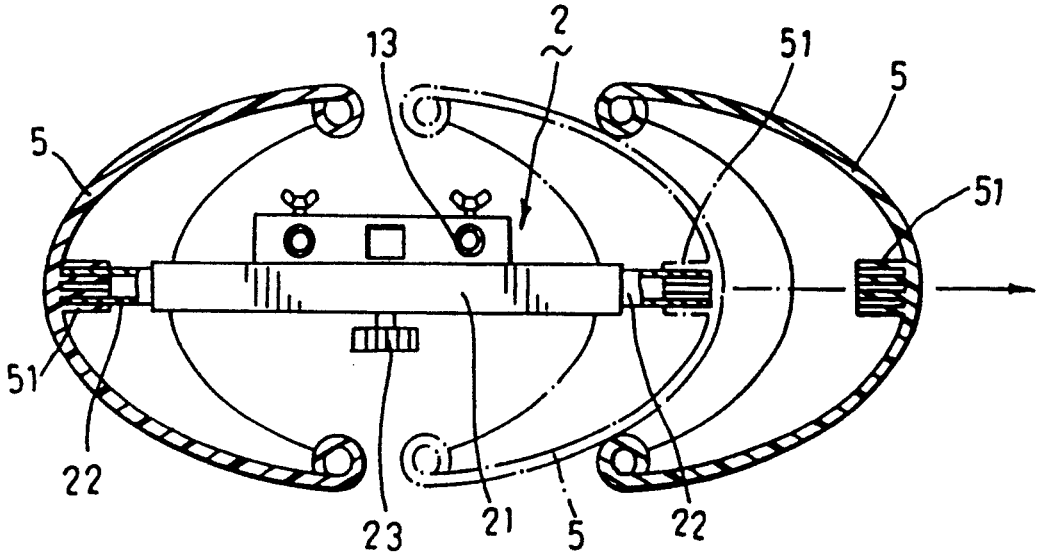
FIG. 5 is a schematic view illustrating how the width of the waist part of the mannequin is adjusted in accordance with this invention.
Figure 6:
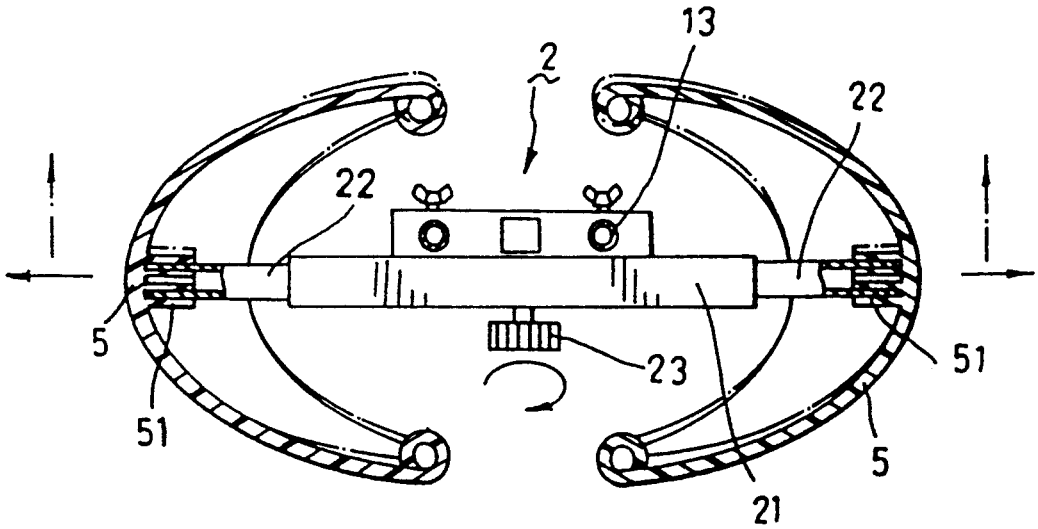
FIG. 6 is a schematic view illustrating how the waist-outline simulating plates are moved forward or rearward relative to the horizontal middle tube of the mannequin in accordance with this invention.

Referring to FIGS. 5 and 6, each of the waist-outline simulating plates (5) includes a row of positioning pins (51) provided on the inner side thereof. Each of the horizontal side tubes (22) may be sleeved selectively on an adjacent pair of positioning pins (51). As described above, it is understood that the positions of the waist-outline simulating plates (5) can be adjusted longitudinally relative to the horizontal middle tube (22), as indicated by phantom lines in FIG. 5, and transversely relative to the horizontal middle tube (22), as indicated by phantom lines in FIG. 6.

Figure 7:
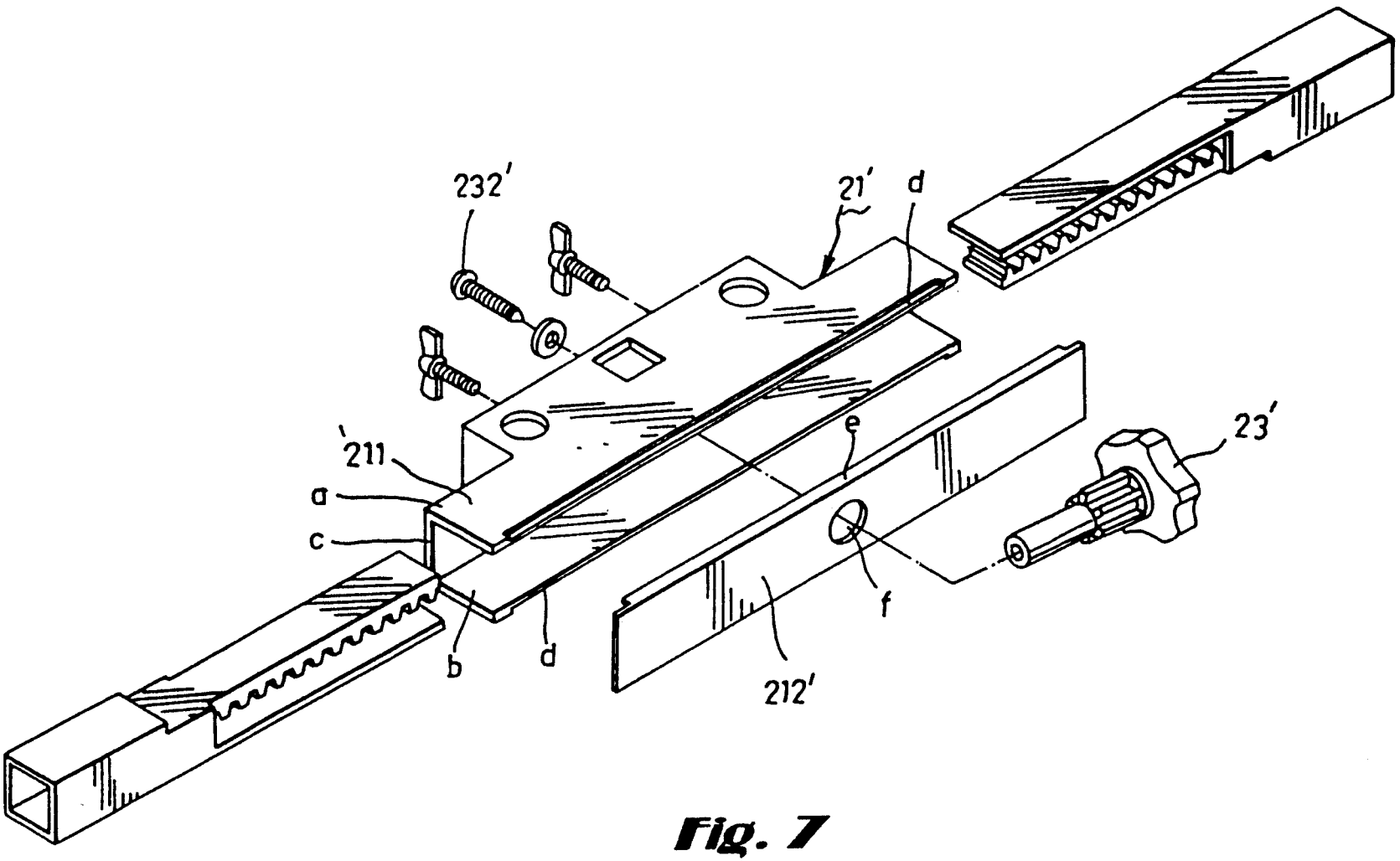
FIG. 7 is an exploded view illustrating an alternative structure of the horizontal middle tube of the mannequin according to this invention.

FIG. 7 shows another embodiment of the horizontal middle tube. In this embodiment, the horizontal middle tube (21') includes a base portion (211') of a U-shaped cross-section and a front cover plate (212'). The base portion (211') has a top wall (a), a bottom wall (b) and a rear wall (c). Each of the top and bottom walls (a, b) has a positioning recess (d) formed therein. The front cover plate (212') includes two positioning tongues (e) (only one is shown in FIG. 7) which are engaged within the positioning recesses (d) so that the base portion (211') and the front cover plate (212') together constitute a tube. The front cover plate (212') has a hole (f) formed therethrough. The rotary knob (23') extends through the hole (f) of the front cover plate (212') so as to engage the lock bolt (232').

Figure 8:
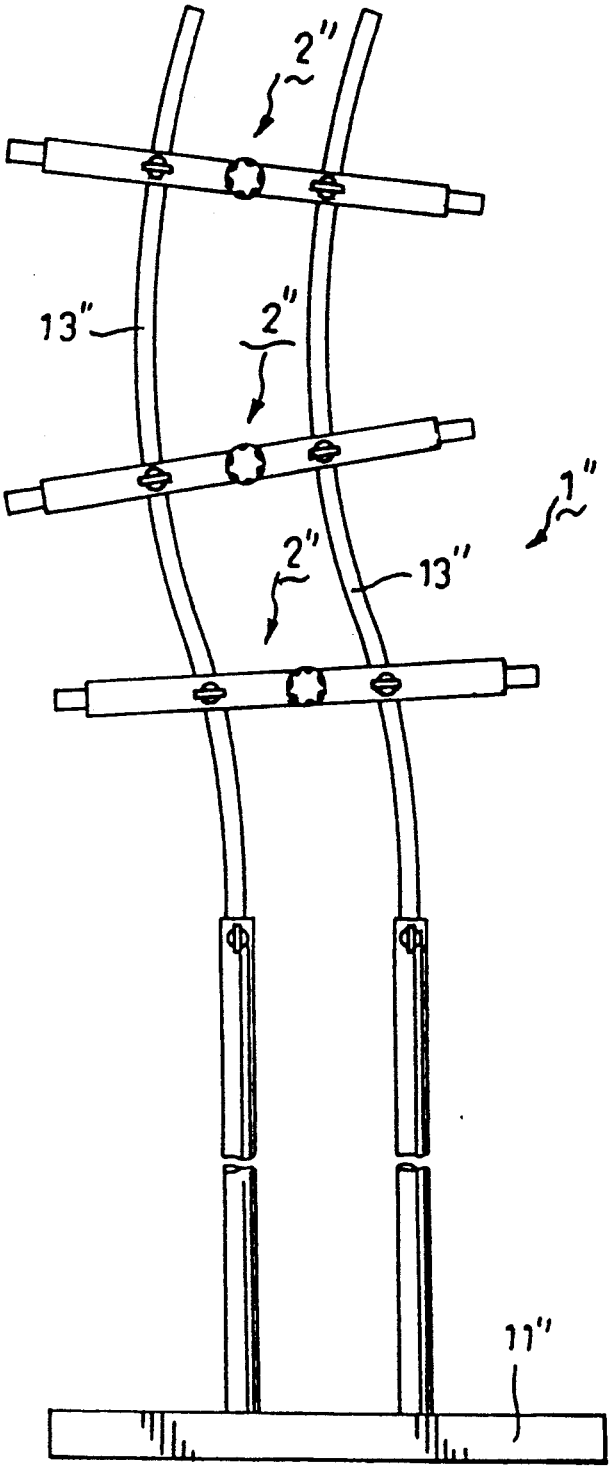
FIG. 8 is an elevational view illustrating an alternative structure of the support frame of the mannequin according to this invention.

FIG. 8 shows another embodiment of the support frame. As illustrated, unlike the first embodiment, the small upper tubes (13") of the support frame (1") are curved. In this case, the horizontal support units (2") are inclined relative to the base plate (11") at different angles. Accordingly, the mannequin can be arranged in a special pose.

With this invention thus explained, it is apparent that numerous modifications and variations can be made without departing from the scope and spirit of this invention. It is therefore intended that this invention be limited only as indicated in the appended claims.

I claim:

1. A mannequin comprising:

a support frame having a base plate and a generally vertical support portion fixed on the base plate;

a horizontal support assembly including an upper horizontal support unit, a middle horizontal support unit and a lower horizontal support unit, said horizontal support units being spaced apart from each other and being mounted movably on said support portion of said support frame, each of said horizontal support units including a generally horizontally middle tube mounted movably on said support portion of said support frame, means for locking said horizontal middle tube releasably on said support frame, two generally horizontal side tubes mounted respectively and movably within two end portions of said horizontal middle tube, and an adjustment unit installed on said horizontal middle tube and actuatable so as to move said horizontal side tubes on said horizontal middle tube, each of said horizontal side tubes including a rack secured to an inner end portion thereof, said adjustment unit being provided with a fixed pinion that engages said racks of said horizontal side tubes so that rotation of said adjustment unit moves said horizontal side tubes relative to said horizontal middle tube;

a cheat-outline simulating plate supported on a top end portion of said support frame;

two shoulder-outline simulating plates respectively supported on outer end portions of said horizontal side tubes of said upper horizontal support unit;

two upper limb units respectively coupled with said shoulder-outline simulating plates;

two waist-outline simulating plates respectively supported on said horizontal side tubes of said middle horizontal support unit;

two hip-outline simulating plates respectively supported on said horizontal side tubes of said lower horizontal support unit;

whereby, each of said horizontal support units has a height and width that can be adjusted; and each of said waist-outline and hip-outline simulating plates including a row of at least three positioning pins provided securely on an inner side thereof so that an outer end of a corresponding said horizontal side tube can be sleeved selectively on an adjacent pair of said positioning pins, whereby, positions of said waist-outline and hip-outline simulating plates are adjustable forward and rearward relative to said support frame.

2. A mannequin comprising:

a support frame having a base plate and a generally vertical support portion fixed on the base plate;

a horizontal support assembly including an upper horizontal support unit, a middle horizontal support unit and a lower horizontal support unit, said horizontal support units being spaced apart from each other and being mounted movably on said support portion of said support frame, each of said horizontal support units including a generally horizontal middle tube mounted movably on said support portion of said support frame, means for locking said horizontal middle tube releasably on said support frame, two generally horizontal side tubes mounted respectively and movably within two end portions of said horizontal middle tube, and an adjustment unit installed on said horizontal middle tube and actuatable so as to move said horizontal side tubes on said horizontal middle tube, each of said horizontal side tubes including a rack secured to an inner end portion thereof, said adjustment unit being provided with a fixed pinion that engages said racks of said horizontal side tubes so that rotation of said adjustment unit moves said horizontal side tubes relative to said horizontal middle tube;

a chest-outline simulating plate supported on a top end portion of said support frame;

two shoulder-outline simulating plates respectively supported on outer end portions of said horizontal side tubes of said upper horizontal support unit;

two upper limb units respectively coupled with said shoulder-outline simulating plates;

two waist-outline simulating plates respectively supported on said horizontal side tubes of said middle horizontal support unit;

two hip-outline simulating plates respectively supported on said horizontal side tubes of said lower horizontal support unit;

whereby, each of said horizontal support units has a height and width that can be adjusted; and each of said horizontal middle tubes having a hole formed therethrough, each of said adjustment units including a rotary knob with an internally threaded stem that extends through said hole of said horizontal middle tube, and a lock bolt engaged threadably with said internally threaded stem of said rotary knob.

3. A mannequin as claimed in claim 2, wherein each of said horizontal middle tubes includes:

a base portion of a U-shaped cross-section attached to said support frame and having a horizontal top wall, a horizontal bottom wall and a vertical rear wall, each of said top and bottom walls having a positioning recess formed therein; and a front cover plate including two positioning tongues projecting therefrom to engage said positioning recesses of said base portion and having a hole formed through said front cover plate, said rotary knob extending through said hole.

* * * * *